US005669989A

United States Patent [19]

Inoue et al.

[11] Patent Number: 5,669,989

[45] Date of Patent: Sep. 23, 1997

[54] NI-FE MAGNETIC ALLOY AND METHOD FOR PRODUCING THEREOF

[75] Inventors: Tadashi Inoue; Kiyoshi Tsuru; Shinichi Okimoto; Naokazu Yamamura; Tetsuo Yamamoto; Hirohisa Haiji, all of Kawasaki, Japan

[73] Assignee: NKK Corporation, Tokyo, Japan

[21] Appl. No.: 547,705

[22] Filed: Oct. 19, 1995

Related U.S. Application Data

[62] Division of Ser. No. 400,858, Mar. 8, 1995, Pat. No. 5,525,164, which is a division of Ser. No. 130,369, Oct. 1, 1993, Pat. No. 5,500,057.

[30] Foreign Application Priority Data

Apr. 30, 1993 [JP] Japan ..... 5-128496

[51] Int. Cl.[6] ..... H01F 1/04

[52] U.S. Cl. ..... 148/312; 148/429; 420/458; 420/459; 420/460

[58] Field of Search ..... 148/312, 429; 420/458, 459, 460

[56] References Cited

U.S. PATENT DOCUMENTS

| | | |
|---|---|---|
| 3,871,927 | 3/1975 | Masumoto et al. . |
| 4,007,066 | 2/1977 | Iijima et al. . |
| 4,441,940 | 4/1984 | Pfeifer et al. . |
| 4,935,201 | 6/1990 | Inoue et al. . |
| 4,948,434 | 8/1990 | Inoue et al. . |
| 5,102,477 | 4/1992 | Iwayama et al. . |
| 5,135,586 | 8/1992 | Meguro et al. . |
| 5,211,771 | 5/1993 | Okiyama et al. . |

FOREIGN PATENT DOCUMENTS

| | | |
|---|---|---|
| 0613781 | 1/1961 | Canada . |
| 60-7017 | 2/1985 | Japan . |
| 62-227054 | 10/1987 | Japan . |
| 2-194154 | 7/1990 | Japan . |
| 4-293755 | 10/1992 | Japan . |

OTHER PUBLICATIONS

JIS–C2531 (1987) pp. 1728–1741.

*Primary Examiner*—John Sheehan

*Attorney, Agent, or Firm*—Frishauf, Holtz, Goodman, Langer & Chick, P.C.

[57] ABSTRACT

A Ni—Fe magnetic alloy consists essentially of: 77 to 80 wt. % Ni, 3.5 to 5 wt. % Mo, 1.5 to 3 wt. % Cu, 0.1 to 1.1 wt. % Mn, 0.1 wt. % or less Cr, 0.003 wt. % or less S, 0.01 wt. % or less P, 0.005 wt. % or less 0, 0.003 wt. % or less N, 0.02 wt. % or less C, 0.001 to 0.05 wt. % Al, 1 wt. % or less Si, 2.6-6 of the weight ratio of Ca to S, (Ca/S), and the balance being Fe and inevitable impurities, satisfies an equation of $3.2 \leqq (2.02\times[Ni]-11.13\times[Mo]-1.25\times[Cu]-5.03\times[Mn])/(2.13\times[Fe]) \leqq 3.8$; and has a Mo segregation ratio defined by a seregration equation satisfying 5% or less, the seregration equation being |(Mo content in a segregation region–Mo average content)/(Mo average content)|×100%. A method for producing a magnetic Ni—Fe alloy comprises the steps of: a first heating step of heating an alloy ingot to 1200° to 1300° C. for 10 to 30 hrs; slabbing the heated ingot at a finishing temperature of 950° C. or more to produce a slab; a second heating step of heating the slab at 1150° to 1270° C. for 1 to 5 hrs; and hot rolling the heated slab at a finishing temperature 950° C. or more.

16 Claims, 3 Drawing Sheets

NI-FE MAGNETIC ALLOY AND METHOD FOR PRODUCING THEREOF

This is a division of application Ser. No. 08/400,858 filed, Mar. 8, 1995 now U.S. Pat. No. 5,525,164, which is a divisional application of Ser. No. 08/130,369 filed Oct. 1, 1993, now U.S. Pat. No. 5,500,057.

BACKGROUND OF THE INVENTION

1. Field of the Invention

This invention relates to a Ni—Fe magnetic alloy having excellent magnetic characteristics and productivity and to a method for producing thereof.

2. Description of the Related Arts

Ni—Fe alloys corresponding to PC (referred to simply as "PC Permalloys" hereafter) defined in JIS (Japanese Industrial Standards) C2531 have widely been used as casings and cores of magnetic heads, magnet cores of various types of transformers, magnetic insulations, etc.

However, ingots of PC Permalloy is inferior in hot workability, and when they are subjected to slabbing, the prepared slabs unavoidably suffer surface defects owing to the reason described later. The hot workability of PC Permalloy varies with the Ni content, and the higher the content of Ni becomes, the more the hot workability degrades. Consequently, the hot workability of an ingot of PC Permalloy containing approximately 80 wt. % Ni is significantly inferior to that of Ni—Fe alloy ingot containing 35 to 45 wt. % of Ni. As a result, in a prior art, slabbing could not be applied for a PC Permalloy ingot to obtain a slab having less surface defects such as edge cracks, or having an excellent surface property, so the forging method was forcefully applied. The reason why the forging method presents a slab having less surface defects is that the method applies mainly compressive force compared with the slabbing in which method multi-axial stress and shearing stress work to an ingot. Different from slabbing method, the forging method gives a poor hot working efficiency, and still it can not drastically reduce the generation of slab surface defect. Accordingly, the forging method also needs a step to remove the slab surface defects, which raises a problem of extra labor and time.

When an ingot of poor hot workability, including PC Permalloy, is subjected to slabbing to form a slab, the obtained slab likely has a lot of surface defects. The reason for the phenomenon is that an ingot experienced slabbing deforms at $1\times1s^{-1}$ or more strain rate and that the temperature at the edge and surface layer at that time is lower than the temperature at the central region of the ingot to become as low as 900° C. The strain rate is represented by strain which occurs for a second as an unit time. As a result, an ingot which has such a temperature gradient within the body induces surface defects such as edge cracks when it is deformed by slabbing.

Particularly when an ingot of PC Permalloy which has poor hot workability is subjected to slabbing, impurity elements begin to segregate at the grain boundaries of austanitic phase during the temperature reduction period of the ingot and to bring the grain boundaries to an embrittlement state, which markedly reduces the ductility at a temperature range of 950° to 1000° C. of the ingot, which then induces lots of defects on the slab surface.

This type of hot workability problems occur also during the production of press shapes by hot pressing of a rolled alloy sheet.

Prior Arts to cope with these problems occurred in a Ni—Fe alloy have been proposed:

(1) Japanese Patent Examined Publication No. 60-7017 discloses that a ferromagnetic Ni—Fe alloy consisting essentially of 75.0 to 84.9 wt. % Ni, 0.5 to 5.0 wt. % Ti, 0.0010 to 0.0020 wt. % Mg, and balance being Fe and inevitable impurities, the content of C and S as the inevitable impurities being C: 0.03 wt. % or less and S: 0.003 wt. % or less (hereafter referred to as "the prior art 1").

(2) Japanese Patent unexamined publication No. 62-227054 discloses a ferromagnetic Ni—Fe alloy consisting essentially of 70 to 85 wt. % Ni, 1.2 wt. % or less Mn, 1.0 to 6.0 wt. % Mo, 1.0 to 6.0 wt. % Cu, 1.0 to 5.0 wt. % Cr, 0.0020 to 0.0150 wt. % B, and balance being Fe and inevitable impurities, the content of S, P, and C as the inevitable impurities being 0.005 wt. % or less S, 0.01 wt. % or less P, and 0.01 wt. % or less C, and the weight ratio of the content of B to the content of the sum of S, P, and C being 0.08 to 7.0 (hereafter referred to as "the prior art 2" hereafter).

As described above, PC Permalloy has a feature of high magnetic permeability and weak coercive force. PC Permalloys which have been brought into practical use include 80% Ni-5% Mo—Fe (Supermalloy) and 77% Ni-5% Cu-4% Mo—Fe (Mo, Cu Permalloy), and they give 150,000 of the initial magnetic permeability and 300,000 of the maximum magnetic permeability as ordinary level.

Recent development of electronics technology demands higher level than described above to utilize miniaturized high performance devices. To cope with the demand, the prior art 2 was introduced as a technology which improves the magnetic characteristics by the reduction of impurities and the addition of Cr.

Those prior arts have, however, problems described below.

The characteristics of the prior art 1 is to improve the hot workability through the fixation of S, an impurity element, by Mg which has a strong tendency to form sulfide. As disclosed in the embodiment, the alloy of the prior art 1 shows, however, a low reduction ratio to a level of 50 to 60% at a temperature range of 950° to 1150° C. which is a particularly important range in industrial processing. As a result, a hot working on the surface of such an alloy induces lots of defects on the slab surface.

The reduction ratio of area described above is defined as the ratio of the difference between the original cross sectional area A of a specimen and the minimum cross sectional area A' at break under a tensile stress at $1s^{-1}$ or more strain rate being represented by the formula of $[(A-A')/A\times100]$ as percentage to the original cross sectional area. The value is measured using a tensile tester to break a specimen.

The characteristic of the prior art 2 is to improve the hot workability of an alloy through the reduction of the content of S, P, and C as impurities and through the addition of B to suppress the segregation of impurity elements to the grain boundaries. According to the experiments carried out by the inventors, however, the alloy of the prior art 2 was found to be extremely inferior in the hot workability. That is to say, the inventors prepared an ingot by melting the alloy No. 5 described in the example of the prior art 2 in a vacuum melting furnace, and cut the ingot to form a specimen of 5 mm diameter and 100 mm length from the prepared ingot. After heating the specimen to 1200° C., it was cooled to 950° C., the reduction ratio of the specimen was determined. The value was 35%.

Consequently, also the alloy of the prior art 2 gives a low reduction ratio at 950° C. level which is an important range in hot working. As a result, when the alloy is subjected to hot working, the obtained slab has lots of surface defects.

Regarding the direct current magnetic characteristics, the reduction of impurities and addition of Cr, which are features of the prior art 2, gave 100,000 level of the initial magnetic permeability at the maximum immediately after the final annealing (1100° C.×3 hrs) in hydrogen atmosphere. So the art can not respond to applications which request higher magnetic characteristics.

Also in the prior art 1, the direct current magnetic permeability immediately after the final annealing (1100° C.×3 hrs) in hydrogen atmosphere gave only 26,000 level of the initial magnetic permeability. So the art also can not cope satisfactorily with the applications which request higher magnetic characteristics.

SUMMARY OF THE INVENTION

The object of the present invention is to provide a magnetic Ni—Fe alloy having excellent hot workability and excellent magnetic characteristics and to provide a method for producing the alloy.

To achieve the object, the invention provides a magnetic Ni—Fe alloy consisting essentially of:

77 to 80 wt. % Ni, 3.5 to 5 wt. % Mo, 1.5 to 3 wt. % Cu, 0.1 to 1.1 wt. % Mn, 0.1 wt. % or less Cr, 0.003 wt. % or less S, 0.01 wt. % or less P, 0.005 wt. % or less O, 0.003 wt. % or less N, 0.02 wt. % or less C, 0.001 to 0.5 wt. % Al, 1 wt. % or less Si, 2.6–6 of the weight ratio of Ca to S, (Ca/S), and the balance being Fe and inevitable impurities;

the alloy satisfying an equation of $3.2 \leqq (2.02\times[Ni]-11.13\times[Mo]-1.25\times[Cu]-5.03\times[Mn])/(2.13\times[Fe]) \leqq 3.8$, where [Ni]is Ni content, [Mo] is Mo content, [Cu] is Cu content, [Mn] is Mn content, and [Fe] is Fe content; and the alloy having a Mo segregation ratio defined by the segregation equation satisfying 5% or less, the segregation equation being |(Mo content in a segregation region–Mo average content)/(Mo average content)|× 100%.

Furthermore, the invention provides a method for producing Ni—Fe magnetic alloy comprising the steps of:

preparing an alloy ingot consisting essentially of 77 to 80 wt. % Ni, 3.5 to 5 wt. % Mo, 1.5 to 3 wt. % Cu, 0.1 to 1.1 wt. % Mn, 0.1 wt. % or less Cr, 0.003 wt. % or less S, 0.01 wt. % or less P, 0.005 wt. % or less O, 0.003 wt. % or less N, 0.02 wt. % or less C, 0.001 to 0.05 wt. % Al, 1 wt. % or less Si, 2.6–6 of the weight ratio of Ca to S, (Ca/S), and the balance being Fe and inevitable impurities;

the alloy satisfying an equation of $3.2 \leqq (2.02\times[Ni]-11.13\times[Mo]-1.25\times[Cu]-5.03\times[Mn])/(2.13\times[Fe]) \leqq 3.8$, where [Ni] is Ni content, [Mo] is Mo content, [Cu] is Cu content, [Mn] is Mn content, and [Fe] is Fe content;

a first heating step of heating the alloy ingot at 1200° to 1300° C. for 10 to 30 hrs;

slabbing the heated ingot at a finishing temperature of 950° C. or more to produce a slab;

a second heating step of heating the slab at 1150° to 1270° C. for 1 to 5 hrs; and hot rolling the heated slab at a finishing temperature of 950° C. or more to produce a hot-rolled product;

whereby a magnetic Ni—Fe alloy is produced, the alloy having a Mo segregation ratio defined by a seregration equation satisfying 0.5% or less, the seregration equation being |(Mo content in a segregation region–Mo average content)/(Mo average content)|×100%.

DESCRIPTION OF THE PREFERRED EMBODIMENT

Figure 1:
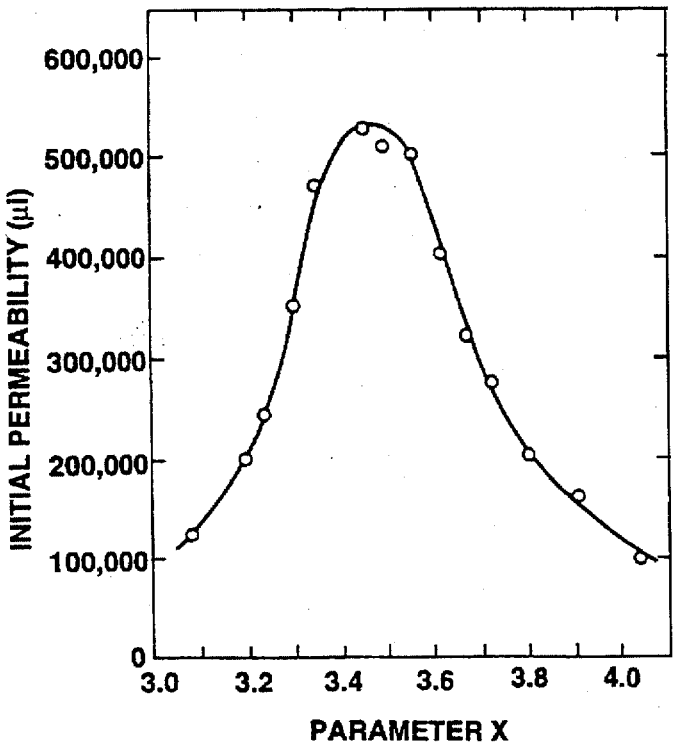
FIG. 1 is a graph showing a relation between the parameter X, which is defined by the present invention, and the initial magnetic permeability.

The magnetic Ni—Fe alloy of the present invention has an improved hot workability as well as a high magnetic permeability which can not be realized by conventional Mo, Cu permalloy and Supermalloy having the similar composition group and, by controlling the content of impurity elements, adding adequate amount of Al and Ca, optimizing the content of added amount of Ni, Mo, Cu, Mn, and Fe, while maintaining the content balance of these elements within a specified range, and controlling the Mo segregation ratio within a specified level.

The following is the detailed description of the present invention with the reason to limit the content of each element.

The improvement of the magnetic characteristics, which is the object of the invention, is realized under the control of the content of P, S, O, N, C, Cr, and Si, which are the impurity elements of the alloy. The reason to limit the content of these elements is describe in the following.

Phosphorus is a harmful element against the hot workability of high Ni—Fe alloy of this invention, and has a role to weaken the ability of formation of cubic texture during the final annealing in hydrogen atmosphere. When the P content exceeds 0.010 wt. %, the initial magnetic permeability degrades, and the hot workability also degrades. Accordingly, the upper limit of P content is specified as 0.010 wt. %. The lower limit of P content is preferably 0.0005 wt. % from the economy of steel making.

Sulfur is a harmful element against hot working, and it is also a very harmful one to the magnetic characteristics because it degrades the magnetic permeability through the suppression of grain growth during the stage of final annealing in hydrogen atmosphere. When the S content exceeds 0.0030 wt. %, the improvement of magnetic characteristics will never be achieved even if the content of Ni, Mo, Cu, Mn, and Fe is optimized (which is described below), and the hot workability is also degraded. Accordingly, the upper limit of S content is specified as 0.0030 wt. %. For further improvement of initial magnetic permeability under direct current application, it is preferable to adopt the S content at 0.0010 wt. % or less. The lower limit of S content is preferably 0.0001 wt. % from the economy of steel making.

Oxygen exists as an oxide inclusion in an alloy of this invention, and excess amount of the oxide inclusion suppresses the grain growth during the stage of final annealing in hydrogen atmosphere and limits the grain size after the annealing at a small size and interferes the improvement of magnetic permeability. Consequently, O is an extremely harmful element for the magnetic characteristics. When O content exceeds 0.0050 wt. %, the improvement of magnetic characteristics, which is the object of this invention, can not be achieved even after the optimization of the content of Ni, Mo, Cu, Mn, and Fe. Therefore, the upper limit of O content is specified as 0.0050 wt. %. For further improvement of initial magnetic permeability, the O content is preferably at 0.0020 wt. % or less. The lower limit of O content is preferably 0.0001 wt. % from the economy of steel making. The range of 0.001 to 0.002 wt. % is most preferable.

Nitrogen forms nitrides in an alloy of this invention, and the nitrides significantly degrade the magnetic characteristics. When N content exceeds 0.0030 wt. %, the magnetic characteristics are considerably degraded from the reason given above. So the upper limit of N content is specified as 0.0030 wt. %. For further improvement of initial magnetic permeability, the N content is preferably selected at 0.0010 wt. % or less. The lower limit of N is preferably 0.0001 from the economy of steel making. The range of 0.0006 to 0.001 wt. % is most preferable.

Carbon exists as an interstitial element in the alloy of this invention and is a harmful element against magnetic characteristics because excess C content degrades magnetic permeability. When the C content exceeds 0.020 wt. %, the degradation of magnetic characteristics becomes severe owing to the reason described above. Therefore, the upper limit of C content is specified as 0.020 wt. %.

Chromium exists as an impurity in the alloys of this invention to degrade the magnetic permeability. When Cr content exceeds 0.10 wt. %, the improvement of initial magnetic permeability, which is the object of this invention, can not be attained. So the upper limit of Cr content is specified as 0.10 wt. %. The lower limit of Cr is preferably 0.001 wt. % from the economy of steelmaking.

Aluminum is an effective component as the deoxidizer. Less than 0.001 wt. % of Al content results in an excess O content specified in this invention. On the other hand, higher than 0.050 wt. % of Al content degrades the magnetic permeability. Accordingly, the Al content is specified to a range of 0.001 to 0.050 wt. %.

Silicon is also an effective component as deoxidizer similar to Al. However, Si content at above 1.0 wt. % degrades the initial magnetic permeability. The presence of 1.0 wt. % or less Si reduces the O content level to a favorable level while not degrading the initial magnetic permeability. So the upper limit of Si content is specified as 1.0 wt. %. The lower limit of Si is preferably 0.0001 wt. % from the economy of steelmaking.

To obtain a high initial magnetic permeability, which is the object of this invention, it is necessary to optimize the addition of each element of Ni, Mo, Cu, Mn, and Fe under the control of impurity content as described above, and to maintain the balance of the content of these elements within a specified range, and to keep the Mo segregation ratio not higher than the specified value. The following is the description of the reason to limit each essential component.

Nickel provides a high magnetic permeability which is targeted by this invention within a range of 77.0 to 80.0 wt. %. Less than 77.0 wt. % or more than 80.0 wt. % of Ni content degrades the magnetic permeability. Accordingly, the Ni content is specified to a range of 77.0 to 80.0 wt. %.

Molybdenum provides a high magnetic permeability which is targeted by this invention within a range of 3.5 to 5.0 wt. %. Less than 3.5 wt. % or more than 5.0 wt. % of Mo content can not improve the magnetic permeability. Consequently, the Mo content is specified to a range of 3.5 to 5.0 wt. %.

Copper has an effect of drastic improvement of direct current magnetic characteristics in an alloy having the composition specified by this invention. This type of Cu effect appears at a composition of 77.0 to 80.0 wt. % Ni and 3.5 to 5.0 wt. % Mo, and the optimum Cu content is in a range of 1.5 to 3.0 wt. %. When the Cu content is less than 1.5 wt. %, the effect of Cu addition does not appear, and when the Cu content is more than 3.0 wt. %, the magnetic characteristics are degraded. Accordingly, the Cu content is specified to a range of 1.5 to 3.0 wt. %.

Manganese affects the magnetic characteristics of an alloy of this invention, similar with Mo and Cu. Presence of Mn more than 1.10 wt. % can not improve the magnetic permeability, and less than 0.10 wt. % degrades the hot workability. Consequently, the Mn content is specified to a range of 0.10 to 1.10 wt. %.

Regarding the balance among the components of Ni, Mo, Cu, Mn, and Fe, the inventors found a parameter X which has particularly clear correlation between the initial magnetic permeability and the balance of those components.

$$X=(2.02\times[Ni]-11.13\times[Mo]-1.25\times[Cu]-5.03\times[Mn])/(2.13\times[Fe])$$

FIG. 1 shows the relation between the parameter X and the initial magnetic permeability on an alloy having the Mo segregation ratio and the content of Ni, Mo, Cu, Mn, Cr, P, S, O, N, C, Si, and Ca within a range specified by this invention. Each specimen was prepared by punching to form a ting having 45 mm of outside diameter and 33 mm of inside diameter from a thin sheet having 1.0 mm of thickness obtained by repeating the cycle of cold rolling, and annealing after hot rolling, followed by heat treating at 1100° C. in hydrogen stream atmosphere for 3 hrs followed by cooling at a rate of 100° C./hr.

As shown in FIG. 1, in the range of the parameter X less than 3.2 or more than 3.8, the initial magnetic permeability is less than 200,000. However, in the range of parameter X between 3.2 and 3.8, high initial magnetic permeability of 200,000 or more is obtained. Consequently, this invention specifies the value of the parameter X in a range of 3.2 to 3.8 which gives the component balance providing a high initial magnetic permeability.

Figure 2:
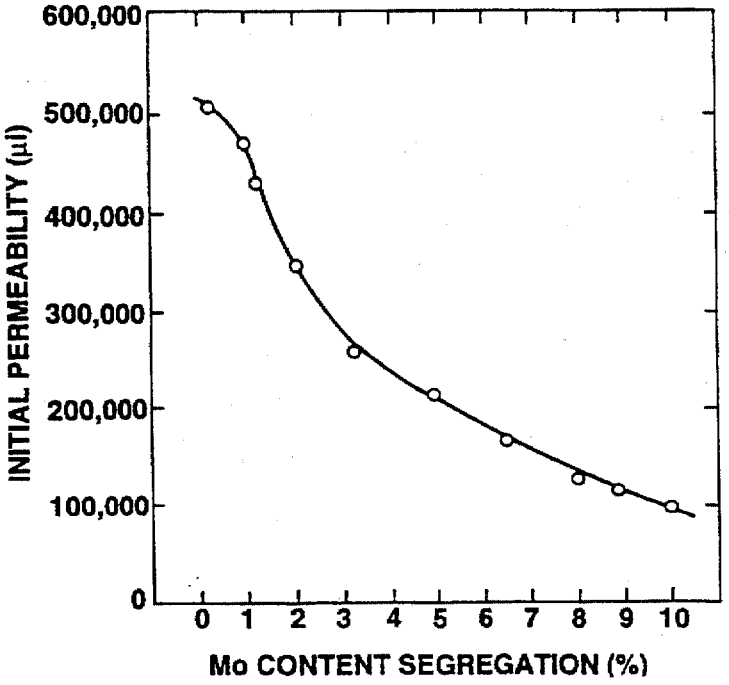
FIG. 2 is a graph showing a relation between the Mo segregation ratio and the initial magnetic permeability according to the present invention.

As for the Mo segregation ratio, FIG. 2 shows the relation between the Mo segregation ratio and the initial magnetic permeability on an alloy having the parameter X in a range of this invention and having the content of Ni, Mo, Cu, Mn, Cr, P, S, O, N, C, Si, Ca, and Al within a range of this invention. The Mo segregation ratio is defined by the equation of $$|([\text{Mo content in a segregation region}]-[\text{Mo average content}])/[\text{Mo average content}]|\times 100\%.$$

The segregation is a state where a solute contained in alloy are heterogeneously dispersed in the alloy. There are two types of the segregation, i.e., from microsmic view, one is segregation existing among denderites when a steel ingot solidifies and from semi-macromistic view, the other is segregation produced dependent on its location of solutes existing in the ingot. The segregation region means the most biased content (the maximum or the minimum) region of the solute to the average content.

According to FIG. 2, at the Mo segregation ratio of 5% or less, high magnetic permeability at 200,000 or more is obtained. Consequently, the present invention specifies the Mo segregation ratio as 5% or less.

The cobalt content is not necessarily specified in this invention. Nevertheless, Co normally exists to some degree in a Ni—Fe alloy as an inevitable impurity. Co content of 1.0% or less usually affects very little to the magnetic permeability, so an alloy of this invention may contain Co at 1.0% or less.

The inventors studied the conditions of composition to provide a magnetic Ni—Fe alloy having high magnetic permeability described above with excellent hot workability, and found that the addition of optimum amount of Ca corresponding to the existing S amount under the composition condition described above, or the addition of having Ca to S ratio ranging 2.6–6.0, drastically improved the hot workability while maintaining the superior magnetic characteristics. The inventors also found that such a significant improvement of hot workability induced by the addition of optimum amount of Ca is resulted from the Ca activity to fix S which is segregated to grain boundaries during solidification of the alloy.

Calcium is to be added at a weight ratio of Ca/S having 2.6 to 6.0. When Ca/S is less than 2.6, the S is not satisfactorily fixed by Ca, and the effect of Ca addition is not fully expected. On the other hand, when Ca/S exceeds 6.0, excess amount of Ca forms an intermetallic compound having a low melting point, which induces grain boundary brittleness and degrades the hot workability of the alloy. The range of the Ca content is preferably 0.003 to 0.018 wt. %.

Figure 3:
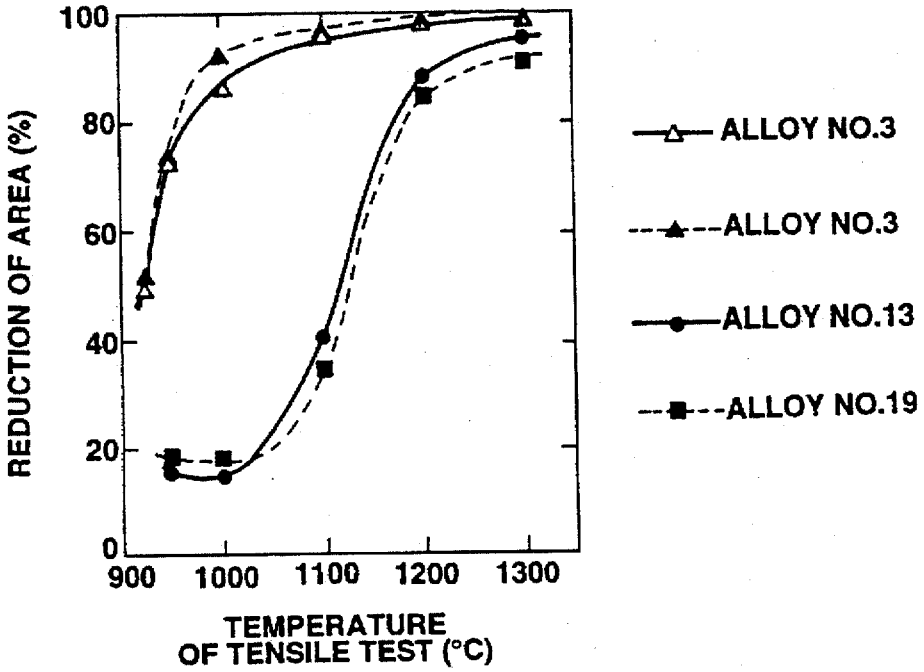
FIG. 3 is a graph showing a relation between the tensile test temperature and the reduction ratio determined on Ni—Fe alloys having different weight ratios of Ca to S, (Ca/S) according to the present invention.

To confirm the effect of Ca addition, the inventors carried out the following experiment. The alloys No. 3 (Ca/S: 3.5, an alloy of the invention), No. 13 (Ca not added, a comparative alloy), and No. 19 (Ca/S: 7.0, a comparative alloy) which are listed in Table 1 were separately melted in an electric furnace followed by refining out of furnace to prepare ingots. From each of these ingots, a specimen having 5 mm diameter and 100 mm length was cut off, which was then heated to 1280° C. for 20 hrs. The specimens were cooled to different temperature levels for tensile test. The reduction ratio of each specimen at each tensile test was determined. In FIG. 3, alloy No. 3 is represented by "-Δ", alloy No. 13 by "-●-" and alloy No. 19 by ". . . ■ . . . ". Separately from the test, the ingot of alloy No. 3 was subjected to slabbing, and a specimen was cut off from the alloy and was treated at 1200° C. for 3 hrs, then was subjected to the similar tensile test as above. In FIG. 3, alloy No. 3 given to the test just mentioned is represented by ". . . ▲ . . . ".

FIG. 3 shows the test results. The reduction ratio of the alloy No. 3 having Ca/S ratio which is 3.5 was larger than those of the alloys No. 13 having Ca/S ratio which is 0 and No. 19 having Ca/S ratio which is 7.0. In particular, the former gave a significantly high value in a temperature range of 950° to 1150° C. which is the important region of hot working. The phenomenon indicates that the alloy No. 3 has an excellent hot workability, and suggests that the necessity of Ca addition within a specified range of Ca/S ratio for the improvement of hot workability of alloy.

Figure 4:
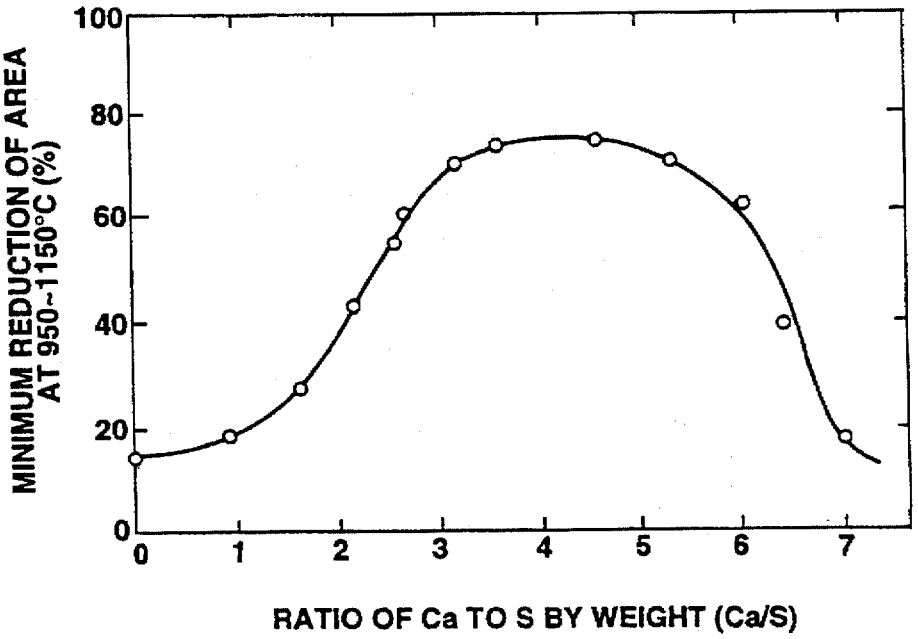
FIG. 4 is a graph showing a relation between the weight ratio of Ca and S, (Ca/S), and the minimum reduction ratio at a temperature range of 950° to 1150° C. according to the present invention.

The inventors carded out the following experiment to identify the optimum weight ratio of Ca to S. The alloys No. 1 through No. 10 (alloys of the invention), No. 13 (a comparative alloy), and No. 19 (a comparative alloy) which are listed in Table 1 were melted in an electric furnace followed by refining out of furnace to prepare ingots. From each of these ingots, a specimen having 5 mm diameter and 100 mm length was cut off, which was then heated to 1280° C. for 20 hrs. The specimens were cooled to 950 to 1150° C. for the determination test of minimum reduction ratio. The results are shown in FIG. 4. According to the figure, Ca/S ratio in a range of 2.6–6.0 gave the reduction ratio higher than 60% which is the target level of this invention. When the Ca/S ratio exceeds 6.0, the initial magnetic permeability degraded. Consequently, the addition of Ca in this invention is specified to 2.6–6.0 of Ca/S ratio.

The following is the description of a method for producing an alloy of the present invention.

According to the production process of an alloy of this invention using slabbing and hot rolling, an alloy base material having the composition described above (including the parameter X) is heated to 1200° to 1300° C. for 10 to 30 hrs, and is subjected to slabbing at the finishing temperature of 950° C. or more, and is heated to 1150° to 1270° C. for 1 to 5 hrs, and is hot rolled at the finishing temperature of 950° C. or more level. The treatment provides a Ni—Fe alloy having very few surface defects and having excellent magnetic characteristics.

Regarding the slabbing of alloy base material, it is necessary to produce a slab having an excellent surface property by applying the hot working under a specific heating condition and finishing temperature described above.

Figure 5:
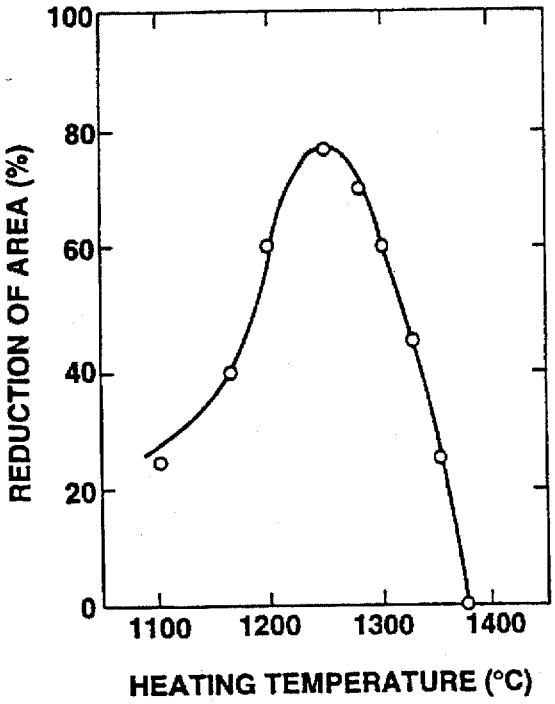
FIG. 5 is a graph showing a relation between the heating temperature and the reduction ratio of a specimen taken from an ingot of Ni—Fe alloy according to the present invention.

To identify the optimum heating temperature during the slabbing, the inventors carried out the following test. The alloy No. 3 (an alloy of the invention) listed in Table 1 was melted in an electric furnace followed by refining out of furnace to prepare ingots. From the ingot, specimens having 5 mm diameter and 100 mm length were cut off, which were then heated to different temperature levels for 20 hrs. The specimens were tested to determine the reduction ratio for each heating temperature level. The results are shown in FIG. 5. According to the figure, within a heating temperature range of 1200° to 1300° C., the reduction ratio more than 60% which is the target level of this invention was obtained. The reason why the range of 1200° to 1300° C. of heating temperature provides a high reduction ratio is that the reduction ratio increases up to 1250° C. owing to the S segregated to grain boundaries and to the P forming the solid solution again and that the reduction ratio decreases above 1250° C. owing to the occurrence of re-segregation of re-formed solid solution of S and P. The heating temperature less than 1200° C. results in Mo segregation ratio exceeding 5%. Accordingly, the temperature of slabbing is limited to a range of 1200° to 1300° C.

As for the heating time, the control of Mo segregation ratio and improvement of hot working condition which are aimed by this invention is achieved by limiting the heating time within a range of 10 to 30 hrs under an optimized hot rolling condition which is described after. Less than 10 hrs of heating time results in Mo segregation ratio exceeding 5%, and more than 30 hrs of heating time induces severe degradation of hot workability. Accordingly, the heating time of slabbing is specified in a range of 10 to 30 hrs.

In the hot rolling which is the succeeding step from slabbing, to obtain a hot rolled coil having a superior surface property, it is necessary to heat the coil at 1150° to 1270° C. for 1 to 5 hrs, followed by hot rolling at 950° C. or higher finishing temperature.

Figure 6:
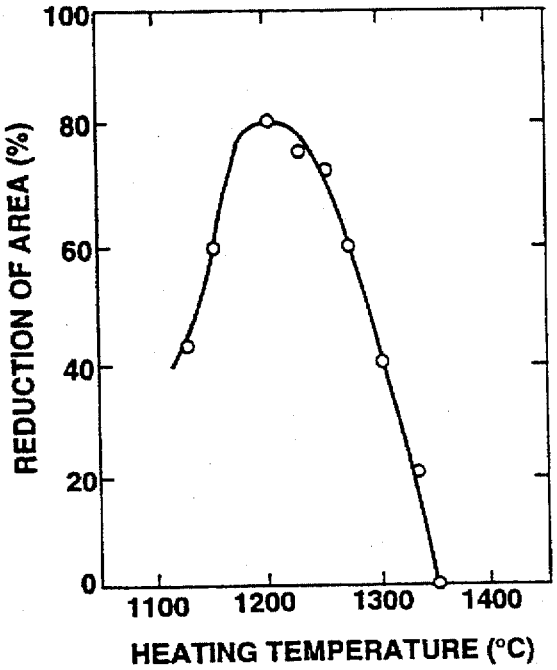
FIG. 6 is a graph showing a relation between the heating temperature and the reduction ratio of a specimen taken from a slab of Ni—Fe alloy according to the present invention.

To identify the optimum heating temperature during the hot rolling, the inventors carded out the following test. The alloy No. 3 (an alloy of the invention) listed in Table 1 was melted in an electric furnace followed by refining out of furnace to prepare ingots. The ingot was subjected to blooming under the conditions of this invention described above. From the ingot, specimens having 5 mm diameter and 100 mm length were cut off, which were then heated to different temperature levels for 3 hrs. The specimens were tested to determine the reduction ratio for each heating temperature level. The results are shown in FIG. 6. According to the figure, within a heating temperature range of 1150° to 1270° C., the reduction ratio more than 60% which is the target level of the invention was obtained. The reason why the range of 1150° to 1270° C of heating temperature provides a high reduction ratio is that the reduction ratio increases up to 1200° C. owing to the S segregated to grain boundaries and to the P forming solid solution again and that the reduction ratio decreases above 1200° C. owing to the occurrence of re-segregation of reformed solid solution of S and P. The heating temperature less than 1150° C. exceeds 5% of Mo segregation ratio. Accordingly, the temperature of slabbing is limited to a range of 1150 to 1270° C.

As for the heating time, the control of Mo segregation ratio and improvement of hot working condition which are aimed by this invention is achieved by limiting the heating time within a range of 1 to 5 hrs under an optimized slabbing condition which is described above. Less than 1 hr of heating time results in Mo segregation ratio more than 5%, and more than 5 hrs of heating time induces severe degradation of hot workability. Accordingly, the heating time of hot rolling is specified in a range of 1 to 5 hrs.

The reason for limiting the finishing temperature of slabbing and hot rolling is described below. According to FIG. 3, the tensile test temperature less than 950° C. induced sudden drop of reduction ratio for the alloy No. 3 (an alloy of this invention), both cast material and slabbing material. This phenomenon is presumably because of higher strength within grains than that at grain boundaries at a temperature less than 950° C. Accordingly, the slabbing and hot rolling are necessary to be performed at or above 950° C. of finishing temperature to produce a slab and hot rolled coil having an excellent surface property.

Generally, the alloys of this invention become the final products through the processing of hot rolling, which is described above, followed by cold rolling and annealing. Nevertheless, the hot rolled material can be the final product.

The method for producing alloys of the present invention is not limited to the one described above. For example, it is acceptable that an alloy having the composition described before is cast into a thin cast plate, which is then subjected to hot rolling or which is applied as-cold rolled state without hot rolling. In the case that a thin cast plate is used as the base material, warm working can be employed to improve the efficiency of cold rolling instead of hot working. By employing the alloys having the composition range of this invention, the generation of surface defects during the casting to the cast plate is suppressed. The thickness of the cast plate is 0.5 to 60 mm and to the cast plate any of the three following production processes can be applied.

In the first process, the cast plate is hot rolled at 800° to 1300° C. and cold rolled. Alternatively before the hot rolling, the cast plate can be heated at 800° C. or more. And before the cold rolling, the hot rolled cast plate can be descaled.

In the second process, the cast plate is warm rolled at 50° to 800° C. and cold rolled. Alternatively before the warm rolling, the cast plate can be heated at 800° C. or more. And also before the cold rolling, the warm rolled cast plate can be descaled.

In the third process, the cast plate is cold rolled without hot rolling before the cold rolling. Before the cold rolling, the cast plate can be descaled.

EXAMPLE 1

The high Ni—Fe alloys having the composition given in Table 1 and Table 2 were melted in an electric furnace and were refined in secondary steel making process, then were cast to ingots. The alloys No. 1 through No. 10 are the ones of the present invention, and the alloys No. 11 through No. 22 are the comparative alloys. After removing surface defects, these ingots were rolled into slabs (under the condition of 1280° C.×10 hrs of heating and 970° C. of the finishing temperature of the rolling for the ingots except for the alloy No. 13; and 1200° C.×10 hrs of heating and 950° C. of the finishing temperature of the rolling for the ingot for the alloy No. 13.) For the slabs having surface defects which have been generated, the defects were removed. All slabs were then applied with an oxidation inhibitor, and were subjected to hot rolling (1200° C.×3 hrs and 950° C. of the finishing temperature of the rolling) to form hot rolled coils. Those hot rolled coils were treated by surface grinding and were subjected to cold rolling to form the cold rolled sheets having 1.0 mm thickness. By annealing these sheets at 930° C., the product coils were obtained. Table 3 and Table 4 list the material characteristics of the alloys of the present invention and of comparative alloys.

In the embodiment, the minimum reduction ratio in a temperature range of 950° to 1150° C. was determined by the following procedure. Round rod specimens (each having 5 mm of diameter and 100 mm of length) were taken from the ingots, and heated to 1280° C. for 20 hrs followed by cooling to different tensile test temperatures. Then the reduction ratio at each tensile test temperature was measured.

Regarding the surface defects of slabs after slabbing, the surface defects at the slab edges were checked because the surface defects tend to occur at slab edges owing to the stress distribution generated during slabbing stage. The quantitization of surface defects at slab edges was carried out by summing up the length of cracks having 2 mm or deeper depth, which cracks were developed within a unit area on the slab edges along the width direction of the slab. When an ingot of Ni—Fe alloy is heated to 1100° C. or more temperature, the grain boundary oxidation occurs, and the phenomenon enhances with the rise of heating temperature. However, the grain boundary oxidation occurs very little when an oxidation inhibitor is applied and when the heating temperature is lowered to 1350° C. or less. In the embodiment (including Example 2 and Example 3 which are described later), an oxidation inhibitor was used and the heating temperature of ingot was lowered to 1350° C. or less. As a result, the surface defects occurred from grain boundary oxidation were remained at a negligible level.

As for the edge cracks on hot rolled coils, the surface inspection of every hot rolled coil was performed on the whole coil length, and the results were evaluated with 4 ranks which are given in Table 3 and Table 4: namely, None: no crack generated Very few: crack generated at a part of the top and bottom of coil Some: crack (2 mm or less) generated along the whole coil length Significant: crack (larger than 2 mm, not larger than 10 mm) generated along the whole coil length The Mo segregation ratio was measured using EPMA (Electronic Probe MicroAnalyzer) across the sheet cross section perpendicular to the rolling direction of product coil, or lateral to the rolling direction, and the following equation was employed to determine the ratio, $$|([\text{Mo content in a segregation region}]-[\text{Mo average content}])/[\text{Mo average content}]|\times 100\%;$$

where [Mo content in a segregation region]: Mo content in a segregation region on a cross section of the alloy (wt. %);

[Mo average content]: Mo average content on a cross section of the alloy (wt. %).

The initial magnetic permeability was determined on a specimen which was prepared by punching to cut a JIS ring having 45 mm of outside diameter and 33 mm of inside diameter from the product coil and by heat treating at 1100° C. for 3 hrs in hydrogen atmosphere followed by cooling at a rate of 100° C./hr.

The materials No. 1 through No. 10 in Table 3 and Table 4 are the alloys satisfying all the specification of composition and Mo segregation of the present invention. They show the minimum reduction ratio in a temperature range of 950° to 1150° C. (hereafter referred to simply as "reduction ratio") above 60%, and they show no surface defect on the slab after slabbing and show no edge crack on the hot rolled coil, which indicates that they have excellent productivity. In addition, these materials have 200,000 or more initial magnetic permeability, which is a superior level. The materials No. 1 through No. 4 are the alloys of the invention which have the parameter X of 3.35 to 3.55 and have more preferable low level of S, O, and N content. These materials give 470,000 or more initial magnetic permeability, which level is the best among the example alloys.

To the contrary, the materials No. 11, No. 12, No. 20, and No. 22 are the comparative examples, the first one of which exceeds the upper limit of the invention in the items of Ni content and parameter X, the second one of which does not reach the lower limit of the invention in the items of Ni content and parameter X, the third one of which exceeds the upper limit of the invention in the item of Al content, and the fourth one of which exceeds the upper limit of this invention in the item Mn content, respectively. All of these comparative examples give lower initial magnetic permeability than that of the examples of the invention.

The material No. 13 is a comparative example containing no Ca. The material gives very low reduction ratio, 14%, and generates lots of defects on slab surface after slabbing, and develops significant edge cracks on hot rolled coil. The Mo segregation ratio of the alloy exceeds 5%, and the initial magnetic permeability is lower than that of the examples of the invention.

The materials No. 14 and No. 15 are the comparative examples which exceed the upper limit of the invention in the item of P content and S content, and which give lower initial magnetic permeability than that of the examples of the invention, as well as very low reduction ratio, 23% and 11%, respectively. They generate lots of defects on the slab surface after slabbing, and show significant edge cracks on the hot rolled coil.

The materials No. 16, No. 17, and No. 18 are the comparative examples which exceed the upper limit of the invention in the items of O content, N content, and C content, respectively. They give a low initial magnetic permeability than that of the examples of the invention.

The material No. 19 is a comparative example which exceeds the upper limit of the invention in the items of Cr content and Ca/S ratio. It gives a low initial magnetic permeability than the examples of the invention. It gives very low reduction ratio, 18%, and it generates lots of defects on the slab surface after slabbing, and develops significant edge cracks on the hot rolled coil.

The material No. 21 is a comparative example which does not reach the lower limit of the invention in the item of Mn content. It gives very low reduction ratio, 20%, and generates lots of defects on the slab surface after slabbing, and gives significant edge cracks on the hot rolled coil.

The materials No. 13, No. 14, No. 15, No. 19, and No. 21 are the comparative examples, which give very low material yield compared with the examples of the invention.

EXAMPLE 2

The ingots of alloys No. 3, No. 6, No. 13, and No. 19 which were used in Example 1 were subjected to slabbing under the condition listed in Table 5 to form slabs. Slabs which generated surface defects were treated by removal of surface imperfections. After applying an oxidation inhibitor onto the slabs, they were treated by hot rolling (1200° C.×3 hrs and 970° C. of the finishing temperature of the rolling) to obtain the hot rolled coils. They underwent the same process with Example 1 to form the product coils having 1.0 mm of thickness. The defects on the slab surface after slabbing, edge cracks on the hot rolled coils, Mo segregation ratio, and initial magnetic permeability were inspected following the same procedure as applied in Example 1. The results are shown in Table 5. The results of the edge cracks were evaluated with 4 ranks as shown example 1.

In Table 5, the materials No. 23 through No. 26 were prepared from the alloys having the composition of the invention using the slabbing and hot rolling conditions specified by the invention. All of these materials give excellent values of Mo segregation, 5% or less, and the initial magnetic permeability, 200,000 or more. They generate no defect on the slab surface after slabbing and no edge crack on the hot rolled coil, and provides superior productivity.

On the other hand, the materials No. 27 through No. 29 are also the alloys having the composition of the invention, but they are the comparative example in terms of slabbing condition, where the heating temperature exceeds the upper limit of the invention, the heating temperature and the heating time do not reach the lower limit of the invention, and the temperature at the end of rolling does not reach the lower limit of the invention, respectively. All of them generate lots of defects on the slab surface after slabbing. In particular, the heating temperature and the heating time during the slabbing of the material No. 28 does not reach the lower limit of the invention, so the Mo segregation of the material exceeds 5%, and the initial magnetic permeability is lower than the examples of the invention.

The materials No. 30 and No. 31 are the examples using comparative alloys. The conditions of slabbing and hot rolling remain within the range of the invention. Nevertheless, they generate lots of defects on the slab surface after slabbing. In particular, the material No. 31 (using the alloy No. 19) shows lower initial magnetic permeability than that of the examples of the invention.

The materials No. 27 through No. 31 give significantly low material yield compared with the examples of the invention.

EXAMPLE 3

The ingots of alloys No. 3 and No. 6 which were used in Example 1 were subjected to slabbing (1280° C.×20 hrs and 970° C. of the finishing temperature of rolling) to form slabs.

Slabs which generated surface defects were treated by removal of surface imperfections. After applying an oxidation inhibitor onto the slabs, they were treated by hot rolling under the condition listed in Table 6 to obtain the hot rolled coils. They then underwent the same process with Example 1 to form the product coils having 1.0 mm of thickness. The edge cracks on the hot rolled coils, Mo segregation ratio, and initial magnetic permeability were inspected following the same procedure as applied in Example 1. The results are shown in Table 6. The results of the edge cracks were evaluated with 4 ranks as shown example 1.

In Table 6, the materials No. 32 through No. 35 were prepared from the alloys having the composition of the invention using the slabbing and hot rolling conditions specified by the invention. All of these materials give excellent values of Mo segregation, 5% or less, and of the initial magnetic permeability, 200,000 or more. They generate no defect on the slab surface after slabbing and no edge crack on the hot rolled coil, and provides superior productivity.

On the other hand, the materials No. 36 through No. 38 are also the alloys having the composition of the invention, and they are the comparative example in terms of hot rolling condition, where the heating time exceeds the upper limit of the invention, the heating temperature exceeds the upper limit of the invention and the heating time do not reach the lower limit of the invention, and the temperature at the end of rolling does not reach the lower limit of the invention, respectively. All of them generate significant edge cracks on the hot rolled coil. In particular, the heating time during the hot rolling of the material No. 37 does not reach the lower limit of the invention, so the Mo segregation of the material exceeds 5%, and the initial magnetic permeability is lower than the examples of the invention.

The materials No. 32 through No. 38 give significantly low material yield compared with the examples of the invention.

TABLE 1

| | Chemical composition (wt. %) (wt %) | | | | | | | | | | | | | | | | ※ |
|---|---|---|---|---|---|---|---|---|---|---|---|---|---|---|---|---|---|
| Alloy No. | Ni | Mo | Cu | Mn | Cr | S | P | O | N | C | Al | Si | Co | Fe | Ca | Ca/S | Pa · X |
| 1 | 78.14 | 4.19 | 2.20 | 0.49 | 0.02 | 0.0008 | 0.002 | 0.0011 | 0.0006 | 0.0012 | 0.019 | 0.05 | 0.01 | 14.83 | 0.0036 | 4.50 | 3.35 |
| 2 | 78.54 | 4.19 | 2.10 | 0.58 | 0.01 | 0.0004 | 0.001 | 0.0015 | 0.0006 | 0.0030 | 0.020 | 0.05 | 0.01 | 14.48 | 0.0021 | 5.25 | 3.45 |
| 3 | 78.66 | 4.20 | 2.10 | 0.58 | 0.02 | 0.0002 | 0.002 | 0.0020 | 0.0006 | 0.0026 | 0.021 | 0.04 | 0.02 | 14.35 | 0.0007 | 3.50 | 3.49 |
| 4 | 78.74 | 4.18 | 2.20 | 0.62 | 0.03 | 0.0008 | 0.003 | 0.0010 | 0.0010 | 0.0010 | 0.045 | 0.04 | 0.02 | 14.11 | 0.0048 | 6.00 | 3.55 |
| 5 | 79.01 | 4.07 | 2.35 | 0.55 | 0.03 | 0.0015 | 0.002 | 0.0024 | 0.0007 | 0.0024 | 0.015 | 0.05 | 0.01 | 13.90 | 0.0039 | 2.60 | 3.67 |
| 6 | 78.30 | 4.01 | 1.53 | 0.61 | 0.03 | 0.0005 | 0.002 | 0.0013 | 0.0007 | 0.0060 | 0.040 | 0.06 | — | 15.41 | 0.0029 | 5.80 | 3.30 |
| 7 | 78.10 | 4.95 | 2.00 | 0.58 | 0.02 | 0.0010 | 0.001 | 0.0030 | 0.0020 | 0.0033 | 0.027 | — | 0.06 | 14.25 | 0.0031 | 3.10 | 3.20 |
| 8 | 78.50 | 3.52 | 2.40 | 0.70 | 0.10 | 0.0020 | 0.008 | 0.0041 | 0.0021 | 0.0145 | 0.003 | 0.01 | 0.05 | 14.68 | 0.0054 | 2.70 | 3.61 |
| 9 | 77.20 | 4.10 | 2.95 | 0.51 | 0.07 | 0.0003 | 0.009 | 0.0043 | 0.0023 | 0.0090 | 0.002 | — | 0.06 | 15.08 | 0.0014 | 4.67 | 3.24 |
| 10 | 79.50 | 3.85 | 1.87 | 1.05 | 0.03 | 0.0006 | 0.002 | 0.0021 | 0.0014 | 0.0075 | 0.032 | 0.06 | — | 13.59 | 0.0030 | 5.00 | 3.80 |

※: Parameter X

TABLE 2

| Alloy | Chemical composition (wt. %) (wt %) | | | | | | | | | | | | | | | | ※ |
|---|---|---|---|---|---|---|---|---|---|---|---|---|---|---|---|---|---|
| No. | Ni | Mo | Cu | Mn | Cr | S | P | O | N | C | Al | Si | Co | Fe | Ca | Ca/S | Pa · X |
| 11 | 80.50 | 3.93 | 1.57 | 0.57 | 0.09 | 0.0021 | 0.010 | 0.0045 | 0.0025 | 0.0110 | 0.002 | <0.01 | 0.02 | 13.24 | 0.0057 | 2.71 | 4.04 |
| 12 | 76.93 | 4.05 | 2.40 | 0.65 | 0.08 | 0.0022 | 0.009 | 0.0050 | 0.0025 | 0.0150 | 0.001 | <0.01 | 0.02 | 15.79 | 0.0063 | 2.86 | 3.09 |
| 13 | 78.15 | 4.02 | 2.65 | 0.52 | 0.08 | 0.0026 | 0.009 | 0.0047 | 0.0024 | 0.0105 | 0.001 | <0.01 | 0.05 | 14.49 | 0.0000 | 0.00 | 3.47 |
| 14 | 78.47 | 4.10 | 2.12 | 0.23 | 0.08 | 0.0023 | 0.015 | 0.0048 | 0.0024 | 0.0100 | 0.001 | <0.01 | 0.06 | 14.90 | 0.0070 | 3.04 | 3.44 |
| 15 | 78.00 | 4.31 | 2.04 | 0.53 | 0.09 | 0.0035 | 0.010 | 0.0049 | 0.0027 | 0.0187 | 0.001 | <0.01 | 0.04 | 14.92 | 0.0091 | 2.60 | 3.28 |
| 16 | 78.70 | 4.25 | 2.03 | 0.87 | 0.10 | 0.0024 | 0.009 | 0.0061 | 0.0028 | 0.0165 | <0.001 | 0.03 | 0.01 | 13.94 | 0.0065 | 2.70 | 3.53 |
| 17 | 78.23 | 4.30 | 1.95 | 0.60 | 0.10 | 0.0022 | 0.009 | 0.0044 | 0.0035 | 0.0171 | 0.002 | 0.01 | 0.01 | 14.62 | 0.0073 | 3.32 | 3.37 |
| 18 | 77.27 | 3.78 | 2.75 | 0.61 | 0.09 | 0.0022 | 0.009 | 0.0045 | 0.0026 | 0.025 | 0.002 | <0.01 | 0.07 | 15.40 | 0.0075 | 3.41 | 3.28 |
| 19 | 77.63 | 3.85 | 2.63 | 0.54 | 0.13 | 0.0024 | 0.010 | 0.0030 | 0.0026 | 0.0115 | 0.004 | 0.03 | 0.04 | 15.13 | 0.0168 | 7.00 | 3.35 |
| 20 | 77.85 | 4.26 | 2.94 | 0.55 | 0.08 | 0.0028 | 0.010 | 0.0009 | 0.0030 | 0.0102 | 0.054 | 0.05 | 0.05 | 14.20 | 0.0068 | 2.43 | 3.42 |
| 21 | 77.95 | 4.20 | 2.18 | 0.05 | 0.08 | 0.0024 | 0.010 | 0.0047 | 0.0025 | 0.0107 | 0.001 | <0.01 | 0.05 | 15.44 | 0.0065 | 2.71 | 3.28 |
| 22 | 78.32 | 4.12 | 2.30 | 1.30 | 0.09 | 0.0025 | 0.010 | 0.0047 | 0.0025 | 0.0195 | 0.002 | <0.01 | 0.01 | 13.77 | 0.0073 | 2.92 | 3.51 |

※: Parameter X

TABLE 3

| Material No. | Alloy No. | Minimum reduction ratio at a temperature range of 950–1150° C. (%) | Defect on the slab surface after slabbing ($cm/cm^2$) | Edge crack on the hot rolled coil | Mo segregation ratio | Initial magnetic permeability μi |
|---|---|---|---|---|---|---|
| 1 | 1 | 73 | 0.00 | None | 1.0 | 470,000 |
| 2 | 2 | 70 | 0.00 | None | 1.2 | 525,000 |
| 3 | 3 | 73 | 0.00 | None | 0.2 | 505,000 |
| 4 | 4 | 62 | 0.00 | None | 1.6 | 500,000 |
| 5 | 5 | 62 | 0.00 | None | 2.0 | 320,000 |
| 6 | 6 | 64 | 0.00 | None | 1.9 | 350,000 |
| 7 | 7 | 70 | 0.00 | None | 4.9 | 200,100 |
| 8 | 8 | 63 | 0.00 | None | 1.6 | 400,200 |

TABLE 3-continued

| Material No. | Alloy No. | Minimum reduction ratio at a temperature range of 950–1150° C. (%) | Defect on the slab surface after slabbing (cm/cm$^2$) | Edge crack on the hot rolled coil | Mo segregation ratio | Initial magnetic permeability μi |
|---|---|---|---|---|---|---|
| 9 | 9 | 73 | 0.00 | None | 3.2 | 244,000 |
| 10 | 10 | 72 | 0.00 | None | 4.3 | 200,100 |

TABLE 4

| Material No. | Alloy No. | Minimum reduction ratio at a temperature range of 950–1150° C. (%) | Defect on the slab surface after slabbing (cm/cm$^2$) | Edge crack on the hot rolled coil | Mo segregation ratio | Initial magnetic permeability μi |
|---|---|---|---|---|---|---|
| 11 | 11 | 60 | 0.01 | Very few | 4.5 | 95,100 |
| 12 | 12 | 60 | 0.01 | Very few | 4.4 | 124,800 |
| 13 | 13 | 14 | 3.40 | Significant | 6.5 | 158,000 |
| 14 | 14 | 23 | 3.20 | Significant | 4.8 | 152,000 |
| 15 | 15 | 11 | 4.20 | Significant | 4.7 | 143,100 |
| 16 | 16 | 59 | 0.10 | Some | 4.8 | 146,500 |
| 17 | 17 | 60 | 0.01 | Very few | 4.9 | 133,000 |
| 18 | 18 | 61 | 0.01 | Very few | 5.0 | 154,000 |
| 19 | 19 | 18 | 3.30 | Significant | 5.0 | 121,400 |
| 20 | 20 | 58 | 0.10 | Some | 4.8 | 102,300 |
| 21 | 21 | 20 | 3.15 | Significant | 4.8 | 200,000 |
| 22 | 22 | 61 | 0.01 | Very few | 4.7 | 156,000 |

TABLE 5

| | | Slabbing | | | Defect on | | | |
|---|---|---|---|---|---|---|---|---|
| Material No. | Alloy No. | Heating temperature (°C.) | Heating time (hr) | Finishing temperature of rolling (°C.) | the slab surface after slabbing (cm/cm$^2$) | Edge crack on the hot rolled coil | Mo segregation ratio (%) | Initial magnetic permeabiligy μi |
| 23 | 3 | 1280 | 20 | 970 | 0.00 | None | 1.2 | 429,000 |
| 24 | 3 | 1250 | 25 | 960 | 0.00 | None | 2.0 | 350,000 |
| 25 | 6 | 1230 | 20 | 970 | 0.00 | None | 2.0 | 345,000 |
| 26 | 6 | 1200 | 30 | 950 | 0.00 | None | 3.2 | 255,000 |
| 27 | 3 | 1325 | 20 | 970 | 2.05 | None | 0.5 | 490,000 |
| 28 | 3 | 1165 | 8 | 960 | 3.15 | None | 8.0 | 119,000 |
| 29 | 3 | 1280 | 20 | 930 | 3.30 | None | 1.1 | 445,000 |
| 30 | 13 | 1280 | 20 | 970 | 4.20 | Significant | 2.0 | 340,000 |
| 31 | 19 | 1280 | 20 | 960 | 3.20 | Significant | 1.2 | 198,000 |

TABLE 6

| | | Slabbing | | | | | |
|---|---|---|---|---|---|---|---|
| Material No. | Alloy No. | Heating temperature (°C.) | Heating time (hr) | Finishing temperature of rolling (°C.) | Edge crack on the hot rolled coil | Mo segregation ratio (%) | Initial magnetic permeabiligy μi |
| 32 | 3 | 1200 | 3 | 960 | None | 1.1 | 462,000 |
| 33 | 3 | 1270 | 1 | 970 | None | 1.3 | 423,000 |
| 34 | 6 | 1200 | 3 | 960 | None | 1.5 | 398,000 |
| 35 | 6 | 1150 | 5 | 950 | None | 1.3 | 414,000 |
| 36 | 3 | 1150 | 6 | 950 | Significant | 1.5 | 385,000 |
| 37 | 3 | 1300 | 0.5 | 1000 | Significant | 5.1 | 165,000 |
| 38 | 3 | 1200 | 3 | 900 | Significant | 1.4 | 410,000 |

What is claimed is:

1. A magnetic Ni—Fe alloy sheet having excellent magnetic permeability and excellent hot workability, said alloy consisting essentially of:

| | | |
|---|---|---|
| 77 to 80 wt. % Ni, | 3.5 to 5 wt. % Mo, | 1.5 to 3 wt. % Cu, |
| 0.1 to 1.1 wt. % Mn, | 0.1 wt. % or less Cr, | 0.003 wt. % or less S, |
| 0.01 wt. % or less P, | 0.005 wt. % or less O, | 0.003 wt. % or less N, |
| 0.02 wt. % or less C, | 0.001 to 0.5 wt. % Al | 1 wt. % or less Si, |

a weight ratio Ca to S, (Ca/S) is 2.6 to 6, and the balance being Fe and inevitable impurities;

said alloy satisfying an equation of:

$$3.2 \leqq (2.02\times[Ni]-11.13\times[Mo]-1.25\times[Cu]-5.03\times[Mn])/(2.13\times[Fe]) \leqq 3.8$$

where [Ni] is Ni content, [Mo] is Mo content, [Cu] is Cu content, [Mn] is Mn content, and [Fe] is Fe content; and said alloy having a Mo segregation ratio defined by the segregation equation satisfying 5% or less, the segregation equation being:

$$|(\text{Mo content in a segregation region}-\text{Mo average content})/(\text{Mo average content})\times 100\%;\ \text{and wherein}$$

said alloy has an initial magnetic permeability ($\mu_i$) of 200,000 or more.

2. The alloy sheet of claim 1, wherein the P content is 0.0005 to 0.001 wt. %.

3. The alloy sheet of claim 1, wherein the S content is 0.0001 to 0.003 wt. %.

4. The alloy sheet of claim 3, wherein the S content is 0.0001 to 0.001 wt. %.

5. The alloy sheet of claim 1, wherein the O content is 0.0001 to 0.005 wt. %.

6. The alloy sheet of claim 5, wherein the O content is 0.001 to 0.002 wt. %.

7. The alloy sheet of claim 1, wherein the N content is 0.0001 to 0.003 wt %.

8. The alloy sheet of claim 1, wherein the N content is 0.0006 to 0.001 wt. %.

9. The alloy sheet of claim 1, wherein the Cr content is 0.001 to 0.1 wt. %.

10. The alloy sheet of claim 1, wherein the Si content is 0.0001 to 1 wt. %.

11. An alloy sheet of claim 1, wherein the alloy satisfies an equation of $$3.35 \leqq (2.02\times[Ni]-11.13\times[Mo]-1.25\times[Cu]-5.03\times[Mn])/(2.13\times[Fe]) \leqq 3.55.$$

12. An alloy sheet of claim 1, wherein the alloy has Mo segregation ratio defined by the segregation equation satisfying 3% or less.

13. An alloy sheet of claim 1, wherein the weight ratio of Ca to S, (Ca/S), is 3–5.5.

14. An alloy sheet of claim 1, wherein the Ca content is 0.0003 to 0.018 wt. %.

15. An alloy sheet of claim 1, further containing 1 wt. % or less Co.

16. The alloy sheet of claim 11, wherein the P content is 0.0005 to 0.01 wt. %;

the S content is 0.0001 to 0.003 wt. %;

the O content is 0.0001 to 0.005 wt. %;

the N content is 0.0001 to 0.003 wt. %;

the Cr content is 0.001 to 0.1 wt. %; and the Si content is 0.0001 to 1 wt. %.

* * * * *

UNITED STATES PATENT AND TRADEMARK OFFICE

CERTIFICATE OF CORRECTION

PATENT NO. : 5,669,989

DATED : September 23, 1997

INVENTOR(S) : Inoue et al

It is certified that error appears in the above-indentified patent and that said Letters Patent is hereby corrected as shown below:

Title Page, at top of page, before "Sep. 23, 1997", insert -- * --.

Title Page, Left Column, after identification of [73] Assignee, insert

--[*] Notice: The term of this patent shall not extend beyond the expiration date of Pat. No. 5,500,057---.

Signed and Sealed this

Seventh Day of April, 1998

Bruce Lehman

*Attest:*

BRUCE LEHMAN

*Attesting Officer*

*Commissioner of Patents and Trademarks*